US006163002A

United States Patent [19]

Ahn et al.

[11] Patent Number: 6,163,002

[45] Date of Patent: Dec. 19, 2000

[54] VACUUM CIRCUIT INTERRUPTER WITH CONTACT STRUCTURE INCLUDING SUPPORT PINS

[75] Inventors: Hee Il Ahn; Hong Tae Park, both of Cheongju, Rep. of Korea

[73] Assignee: LG Industrial Systems Co., Ltd., Seoul, Rep. of Korea

[21] Appl. No.: 09/354,149

[22] Filed: Jul. 16, 1999

[30] Foreign Application Priority Data

Jul. 18, 1998 [KR] Rep. of Korea ..... 98-29028

[51] Int. Cl.[7] ..... H01H 33/66

[52] U.S. Cl. ..... 218/123; 218/128; 218/127

[58] Field of Search ..... 218/118–140, 146

[56] References Cited

U.S. PATENT DOCUMENTS

| | | | |
|---|---|---|---|
| 4,079,217 | 3/1978 | Oeschger | 218/135 |
| 4,196,327 | 4/1980 | Kurosawa et al. | 218/129 |
| 4,246,458 | 1/1981 | Yanabu et al. | 218/126 |
| 4,367,382 | 1/1983 | Suzuki et al. | 218/129 |
| 4,415,787 | 11/1983 | Yamanaka | 218/128 |
| 4,473,731 | 9/1984 | Yorita | 218/123 |
| 4,588,879 | 5/1986 | Noda et al. | 218/127 |
| 4,618,750 | 10/1986 | Zuckler | 218/129 |
| 4,667,070 | 5/1987 | Zuckler | 218/129 |
| 5,055,639 | 10/1991 | Schels et al. | 218/129 |
| 5,438,174 | 8/1995 | Slade | 218/118 |
| 5,461,205 | 10/1995 | Schulman | 218/123 |

*Primary Examiner*—J. R. Scott
*Attorney, Agent, or Firm*—Birch, Stewart, Kolasch & Birch, LLP

[57] ABSTRACT

The present invention relates to an interrupter for a circuit breaker for a transmission or distribution line which can distribute and weaken an arc resulting from separation of contacts, can reduce loss of the contacts by the arc, and can improve interruption performance, when an abnormal current such as overcurrent is generated. A plurality of horizontal loops of conductive path are formed on a fixed electrode and a movable electrode, thereby forming a plurality of vertical magnetic fields in parallel with a generation direction of the arc. When the arc is generated between a fixed contactor and a movable contactor respectively connected to the fixed electrode and the movable electrode, the arc can be evenly distributed on the fixed and movable contactors. At the same time, a movement of the arc can be interrupted.

13 Claims, 9 Drawing Sheets

VACUUM CIRCUIT INTERRUPTER WITH CONTACT STRUCTURE INCLUDING SUPPORT PINS

BACKGROUND OF THE INVENTION

1. Field of the Invention

The present invention relates to a circuit breaker used for a power transmission line or a power distribution line, and in particular to an interrupter for a circuit breaker which can distribute and weaken an arc resulting from separation of contacts, can reduce loss of the contacts by the arc, and can improve interruption performance, in case an abnormal current, such as an overcurrent is generated, by providing a movable electrode and a fixed electrode which can form a plurality of vertical magnetic fields in parallel with a generation direction of the arc.

2. Description of the Background Art

In general, a circuit breaker is employed in a power transmission line, a power distribution line or independent transformation facilities of electrical energy in order to protect devices at a load side, such as an electric transformer or a motor from an abnormal current. The circuit breaker must be provided with high breaking performance, safety and reliability.

In an atmosphere in a container having an interrupter, the circuit breaker is classified into an oil circuit breaker using oil, a gas-insulated circuit breaker employing $SF_6$, an air insulated circuit breaker using air, a magnetic blow-out circuit breaker utilizing a magnetic field, and a vacuum circuit breaker using a good insulation property and a rapid arc extinguishing operation in a vacuum atmosphere.

Among these circuit breakers, the vacuum circuit breaker has a superior insulation recovery property. Since the vacuum circuit breaker was manufactured in the 1960s to open/close a contact in a vacuum, it has achieved high voltage, large current operation and a small size.

The interrupter which is a major constitutional component of the vacuum circuit breaker is provided with two electrodes respectively having a contact connected to each other in an insulated container hermetically sealed in order to maintain a vacuum state.

One of the two electrodes is connected to a trip mechanism operated by a trip signal of a control circuit sensing the abnormal current, and to a link connected to the trip mechanism, and thus is operated separately from the other electrode with their contacts connected.

The electrodes of the interrupter tend to be easily melted and hardened by the arc generated when the contacts are separated. Accordingly, there is a need for improving a melting and hardening resistance property.

A spiral or helix contact or a contrate contact has been fabricated, in order to improve the melting and hardening resistance property of the contact composing the electrode of the interrupter. The contact is prevented from being melted and hardened due to concentration of the arc by applying a magnetic field which is perpendicular (horizontal direction) to the arc generated when the abnormal current is interrupted, and by moving the arc in the horizontal direction.

An example of the conventional interrupter electrode structure composing the circuit breaker will now be described with reference to the accompanying drawings.

FIG. 1 illustrates a turn-off state of the conventional interrupter having the spiral contact. The interrupter includes an insulated container 10 formed in a cylindrical shape, and maintaining a vacuum state having its both end portions welded with covers 20, 21; and a fixed electrode 30 and a movable electrode 40 respectively, having contacts 31, 41 symmetrically arranged in the insulated container 10, and connected with or separated from each other, contact shields 32, 42, and cylindrical electrodes 33, 43.

The electrode 33 of the fixed electrode 30 is welded in order for a protrusion (not shown) of its front edge portion to be passed through the contact shield 32 and to be connected to the contact 31, and its rear edge portion is passed through the cover 20, and connected to a fixed terminal 34 connected to a power source(not shown) of a main circuit.

The electrode 43 of the movable electrode 40 is welded so that a protrusion (not shown) of its front edge portion can be passed through the contact shield 42 and connected to the contact 41. A bush 44 is provided to an outer surface of the electrode bar 43, passing through the cover 21. A rear edge portion of the electrode bar 43 is externally protruded through the bush 44, and connected to a link (not shown) connected to a trip mechanism (not shown).

A bellows 45 is provided to an outer surface of the bush 44. The bellows 45 is shrunken or relaxed according to movement of the movable electrode 43, and interrupts air entering through a gap between the electrode bar 43 and an inner wall of the bush 44, thereby maintaining the vacuum state of the insulated container 10.

FIGS. 2 and 3 are a plan view and a cross-sectional view respectively illustrating the contacts 31, 41. The contacts 31, 41 will now be explained in more detail.

The contacts 31, 41 respectively include a plane-shaped contact portion 60 which is side-connected in a turn-on state, and a slant surface 70 which is not connected. A groove 90 having a predetermined depth is formed at a center of the contact portion 60. A plurality of L-shaped slits 80 are formed from the contact unit 60 and the slant surface 70, thereby forming a windmill shape.

Reference numeral 50 depicts a fixed ring, and reference numerals 51, 52 and 53 depict shields for protecting adjacent components from the arc generated when the contacts 31, 41 are separated.

The operation of the conventional interrupter will now be described.

In a state where the contacts 31, 41 of the electrodes 30, 40 are connected, if the abnormal current flows from the fixed side to the movable side, or vise versa, the movable contact 41 is separated from the fixed contact 31 by the link connected to the trip mechanism operated by receiving a turn-off signal, and thus the arc is generated from the contact portion 60 of the contacts 31, 41.

Here, a magnetic field is formed around the arc due to the arc current flowing along the arc. This magnetic field is in a horizontal direction.

Accordingly, as the time lapses, the arc consecutively alternated with the horizontal magnetic field receives the Lorentz force, and moves from the contact portion 60 of the contacts 31, 41 to the slant surface 70, thereby preventing the contacts 31, 41 from being partially heated and damaged.

However, in the conventional contact, if the arc current flowing when the abnormal current is interrupted is over 8kA, the arc tends to be concentrated on a single point of the contact portion 60. The concentrated arc is also moved by the Lorentz force.

Therefore, a melting phenomenon takes place in the contact by the concentrated arc. Furthermore, a melting and hardening line is formed in the contact along the movement path of the concentrated arc, and thus the contact is damaged or melted and hardened.

As a result, it is impossible to use the conventional contact in order to interrupt the abnormal current over 40kA.

SUMMARY OF THE INVENTION

Accordingly, it is an object of the present invention to provide an interrupter for a circuit breaker which can distribute an arc, rapidly extinguish the arc, and interrupt a high abnormal current, by providing to an electrode of the interrupter an electrode structure forming a plurality of vertical magnetic fields in parallel with a generation direction of the arc.

In order to achieve the above-described object of the present invention, there is provided an interrupter for a circuit breaker including: a fixed electrode having a plurality of horizontal loops of electrically conductive paths in order to form a plurality of vertical magnetic fields; a fixed contactor electrically connected to the fixed electrode; a movable electrode having a plurality of horizontal loops of electrically conductive paths in order to form a plurality of vertical magnetic fields; and a movable contactor electrically connected to the movable electrode, and movable to a position connected to the fixed contactor for electrical connection therewith, or movable separately from the fixed contactor for electrical interruption therefrom.

The object of the present invention, the means for achieving the object, and the constitution and operation thereof will be more apparently understood by reading the detailed description of the present invention with reference to the accompanying drawings.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

An interrupter for a circuit breaker in accordance with the present invention will now be explained with reference to the accompanying drawings.

Figures 5A, 5B, 5C:
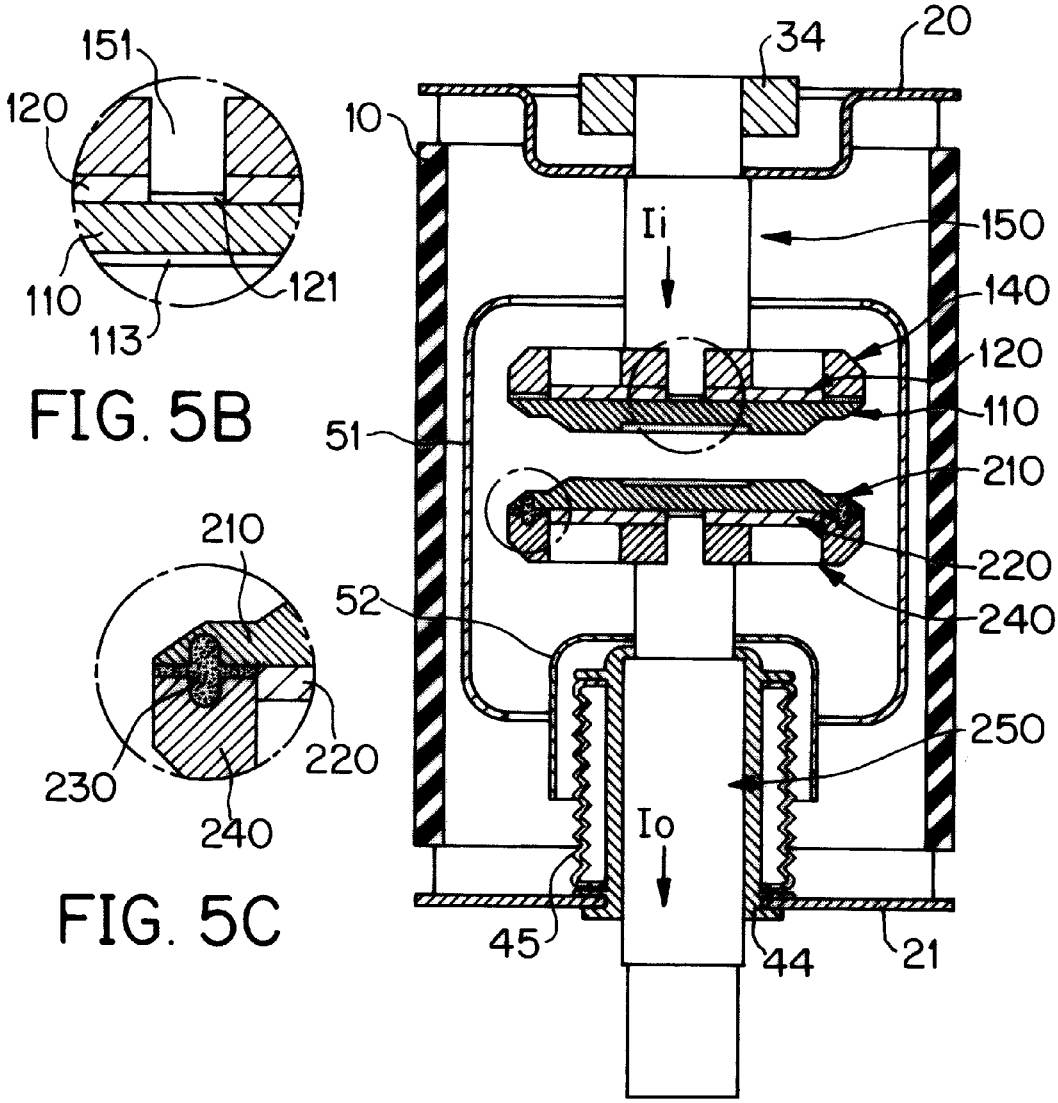
FIG. 5 is a cross-sectional view illustrating a turn-off state of an interrupter for a circuit breaker in accordance with the present invention.
Figure 6:
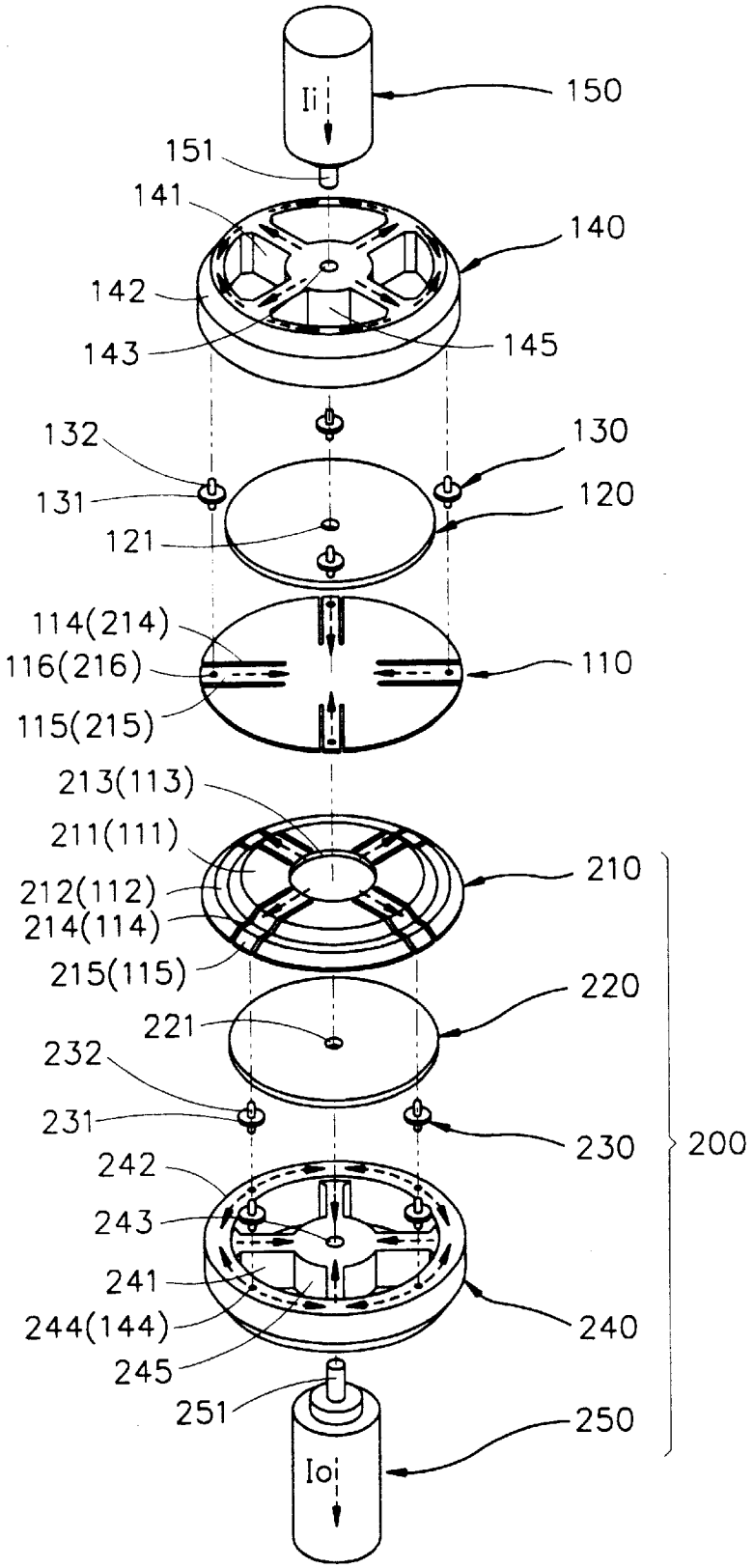
FIG. 6 is an exploded perspective view illustrating a structure of the interrupter in accordance with a first embodiment of the present invention.

FIG. 5 is a cross-sectional view illustrating a turn-off state of the interrupter for the circuit breaker in accordance with the present invention. FIG. 6 is an exploded perspective view for explaining the constitution and assembly method of an electrode and a contactor of the interrupter for the circuit breaker in accordance with a first embodiment of the present invention.

Referring to FIG. 5, the interrupter in accordance with the present invention includes an insulated container 10 formed in a cylindrical shape, and maintaining a vacuum state having its upper and lower end portions welded with covers 20, 21; a fixed contactor 110 and a movable contactor 210 arranged in the insulated container 10, facing each other, and connected with or separated from each other; a wheel-shaped fixed electrode 140 and a wheel-shaped movable electrode 240 connected respectively to one surfaces of the fixed contactor 110 and the movable contactor 210; and a cylindrical fixed electrode 150 and a cylindrical movable electrode 250 connected respectively to the other surfaces of the fixed contactor 110 and the movable contactor 210.

The container 10 is filled with a vacuum or insulation gas having a good electrical insulation property, for instance, $SF_6$ or oil.

The interrupter in accordance with the present invention further includes: a plurality of first conductive pins 130 positioned between the wheel-shaped fixed electrode 140 and the fixed contactor 110 in order to electrically connect them; a first mechanical reinforcing member 120 positioned between the wheel-shaped fixed electrode 140 and the fixed contactor 110, and preventing an impact generated when the contactors 110, 210 are connected from being concentrated on the plurality of first conductive pins 130; a plurality of second conductive pins 230 positioned between the wheel-shaped movable electrode 240 and the movable contactor 210 in order to electrically connect them; and a second mechanical reinforcing member 220 positioned between the wheel-shaped movable electrode 240 and the movable contactor 210, and preventing an impact generated when the contactors 110, 210 are connected from being concentrated on the plurality of second conductive pins 230.

The cylindrical fixed electrode 150 includes a cylinder-shaped body portion, and a protrusion 151 extended from the body portion, and having a smaller diameter than the body portion.

The protrusion 151 of the cylindrical fixed electrode 150 is vertically passed through the wheel-shaped fixed electrode 140, and inserted into an insertion hole 121 formed at the center of the first reinforcing member 120. The body portion of the cylindrical fixed electrode 150 is passed through the cover 20, and connected to a fixed terminal 34 connected to the power source or load of a main circuit.

The cylindrical movable electrode 250 has a cylinder-shaped body portion, and a protrusion 251 extended from the body portion, and having a smaller diameter than the body portion.

The protrusion 251 of the cylindrical movable electrode 250 is vertically passed through the wheel-shaped movable electrode 240, and inserted into an insertion hole 221 formed at the center of the second reinforcing member 220. A bush 44 is provided to the outer surface of the cylindrical movable electrode 250, passing through the cover 21. The body portion of the cylindrical movable electrode 250 is externally protruded through the bush 44, and connected to a link (not shown) connected to a trip mechanism (not shown).

A bellows 45 is provided to the outer surface of the bush 44. The bellows 45 is shrunken or relaxed according to movement of the cylindrical movable electrode 250, and interrupts air entering through a gap between the cylindrical movable electrode 250 and an inner wall of the bush 44, thereby maintaining the vacuum state of the container 10.

Reference numeral 50 depicts a fixing ring, and reference numerals 51, 52 and 53 depict shields for protecting adjacent components from the arc generated when the contacts 31, 41 are separated.

The interrupter for the circuit breaker in accordance with the present invention, as shown in FIG. 5, is at a turn-off state. However, in a turn-on state, the movable contactor 210 in FIG. 5 is in contact with the fixed contactor 110.

On the other hand, the fixed contactor 110 and the movable contactor 210 are formed in a disc shape. The one surfaces of the fixed contactor 110 and the movable contactor 210 respectively include: contacts 111, 211; slant surfaces gradually slanted in a radius direction from the contacts 111, 211; and grooves 113, 213 formed at the center portions of the contacts 111, 211. The other surfaces of the fixed contactor 110 and the movable contactor 210 respectively consist of flat surfaces facing to the reinforcing members 120, 220.

Accordingly, when the fixed contactor 110 and the movable contactor 210 are connected, the contacts 111, 211 are merely connected to each other, and the slant surfaces 112, 212 and the grooves 113, 213 are not connected.

Here, the slant surfaces 112, 212 are formed at the fixed contactor 110 and the movable contactor 210 in order to rapidly perform an interruption operation of the current when the two contactors 110, 210 are separated due to generation of the abnormal current (overcurrent exceeding a permitted current), by reducing a contact area between the fixed contactor 110 and the movable contactor 210.

In addition, the grooves 113, 213 are formed at the center portions of the contacts 111, 211 of the fixed contactor 110 and the movable contactor 210 in order to prevent the arc from being generated at the center portions of the contacts 111, 211 of the fixed contactor 110 and the movable contactor 210 located far from the vertical magnetic field formed by the wheel-shaped fixed electrode 140 and the wheel-shaped movable electrode 240.

That is, the vertical magnetic field formed by the wheel-shaped fixed electrode 140 and the wheel-shaped movable electrode 240 is in parallel with the arc generated between the contacts 111, 211, and thus weakens the arc. It prevents the arc from being generated at the center portions of the contacts 111, 211 which are positioned relatively far from the vertical magnetic field.

As illustrated in an upper circle of FIG. 5, the protrusion 151 is separated from the fixed contactor 110 at a predetermined interval. Accordingly, the current does not flow from the cylindrical electrodes 150, 250 or the wheel-shaped electrodes 140, 240 to the contactors 110, 210, or vise versa, but mostly flows through the conductive pins 130, 230.

When the interrupter according to the present invention is turned on, the fixed contactor 110 and the movable contactor 210 are connected to each other.

Here, in case an input current li flows to the cylindrical fixed electrode 150 via the fixed terminal 34 connected to the power source, the input current li flows to the wheel-shaped fixed electrode 140 via the body portion and the protrusion 151 of the cylindrical fixed electrode 150.

Thereafter, the input current li flows from the wheel-shaped fixed electrode 140 to the fixed contactor 110 via the first conductive pin 130.

It is preferable to use a stainless steel as a material of the reinforcing member 120, and to employ a deoxidized copper as a material of the first conductive pin 130 so that the input current li flows to the wheel-shaped fixed electrode 140 through the first conductive pin 130, not through the reinforcing member 120.

Identically, the deoxidized copper is used as a material of the second conductive pin 230, and the stainless steel is used as a material of the reinforcing member 220.

The input current li flows from the fixed contactor 110 to the wheel-shaped movable electrode 240 via the movable contactor 210 and the second conductive pin 230, and becomes an output current lo outputted through the cylindrical movable electrode 250 from the wheel-shaped movable electrode 240.

Then, the output current lo is supplied to the load side (not shown).

On the other hand, in a state where the contactors 110, 210 of the two electrodes 140, 240 are contacted, that is, the interrupter is turned on, if the abnormal current flows from the electrode at the fixed side to the electrode at the movable side, or vise versa, the cylindrical movable electrode 250 is moved to a lower direction in said Figure by the link connected to the trip mechanism operated when a large current is generated.

Therefore, the movable contactor 210 is separated from the fixed contactor 110, thereby interrupting the electrical connection at the power source side and the load side.

When the movable contactor 210 is separated from the fixed contactor 110, namely the interrupter is turned off, a vertical arc is generated between the contacts of the contactors 110, 210.

The wheel-shaped movable electrode 240 and the wheel-shaped fixed electrode 140 are wheel-shaped conductors respectively having a spoke member and a rim member. When the current flows to the electrodes 140, 240, a plurality of vertical magnetic fields are formed in parallel with a generation direction of the arc by a plurality of horizontal loops of electrically conductive path consisting of the spoke member and the rim member. It will be explained later in more detail with reference to FIG. 6.

The plurality of vertical magnetic fields in parallel with the generation direction of the arc distribute the arc not to be concentrated on a single point, and interrupt the movement of the arc by shutting it between the adjacent vertical magnetic fields, thereby rapidly extinguishing the arc at a low voltage.

Accordingly, the contact is not melted due to the generation of a high arc voltage resulting from the concentration of the arc. In addition, the melting line is not generated at the contact due to the movement of the concentrated arc.

The constitution, assembly method and operation of the interrupter for the circuit breaker in accordance with the first embodiment of the present invention will now be described in more detail with reference to FIG. 6.

The protrusion 151 extended from the body portion of the cylindrical fixed electrode 150 is provided facing to the wheel-shaped fixed electrode 140, and the protrusion 251 extended from the body portion of the cylindrical movable electrode 250 is provided facing to the wheel-shaped movable electrode 240.

Figure 1:
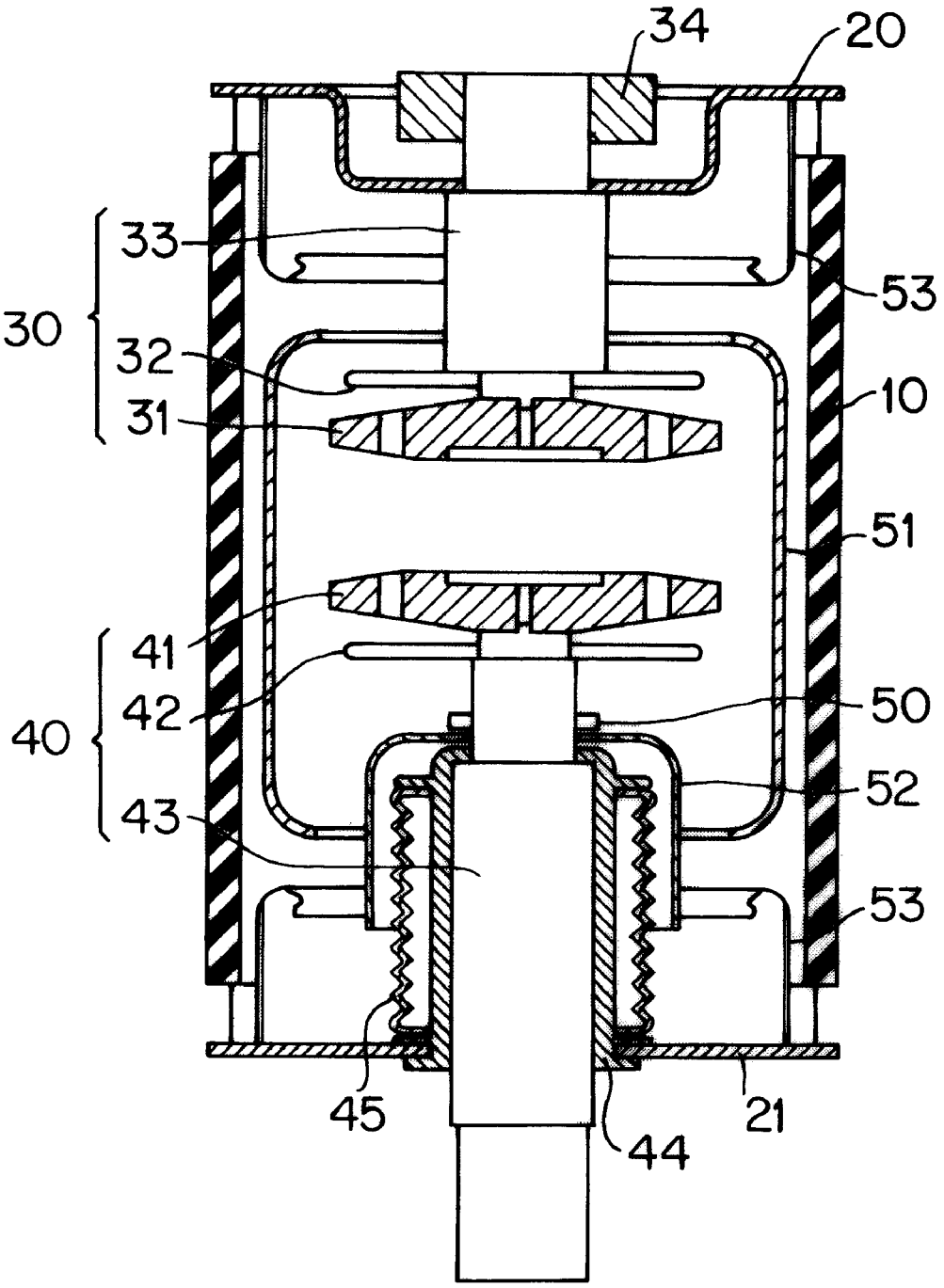
FIG. 1 CONVENTIONAL ART
FIG. 1 is a cross-sectional view illustrating a turn-off state of an interrupter for the conventional circuit breaker.
Figure 2:
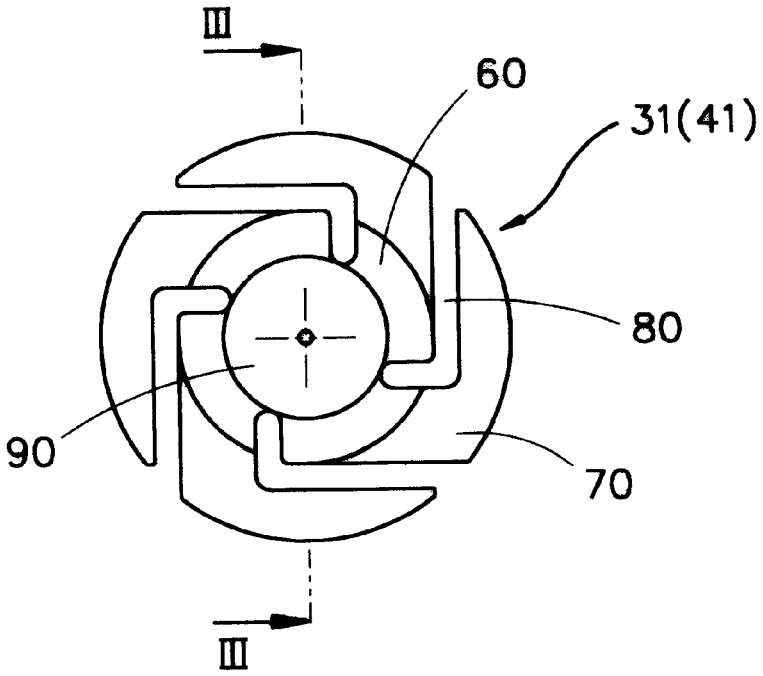
FIG.2 CONVENTIONAL ART
FIG. 2 is a plan view illustrating a contactor of the interrupter for the conventional circuit breaker.
Figure 3:
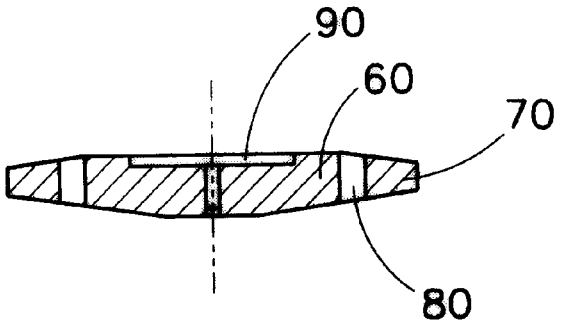
FIG.3 CONVENTIONAL ART
FIG. 3 is a cross-sectional view taken along line III–III' in FIG. 2.
Figure 4:
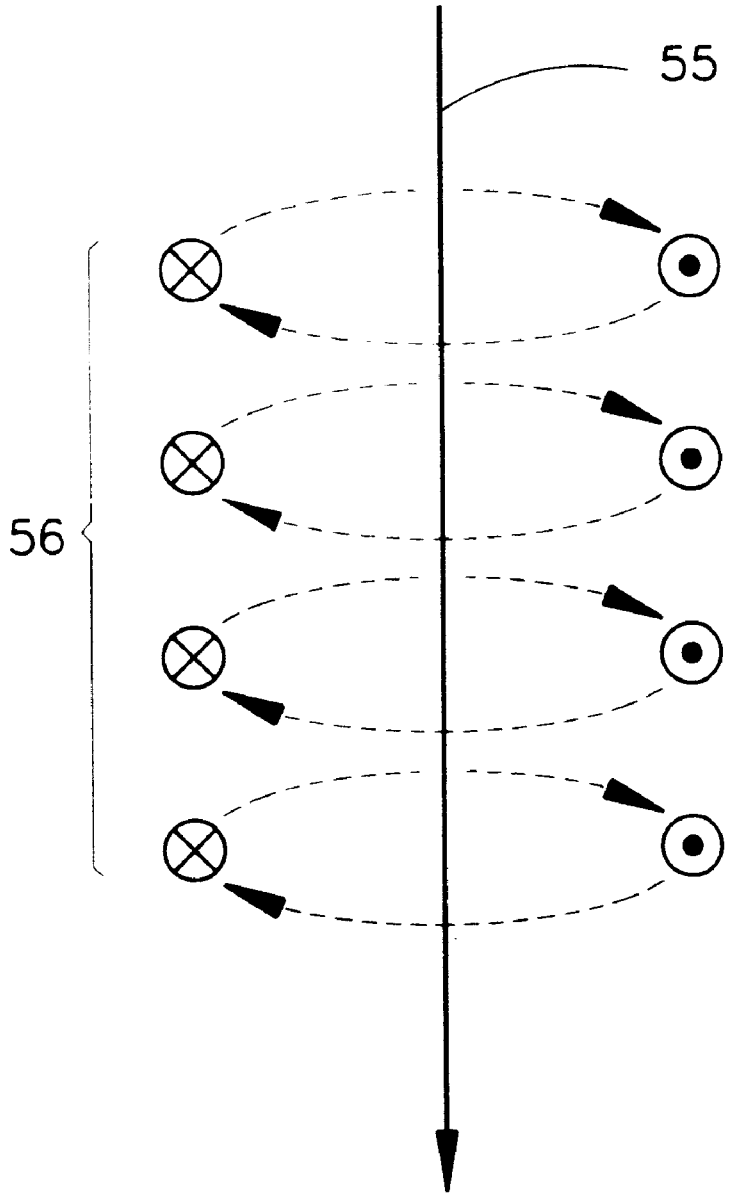
FIG. 4 CONVENTIONAL ART
FIG. 4 is a schematic view for explaining formation of an arc and a magnetic field in the interrupter for the conventional circuit breaker.

Here, the cylindrical fixed electrode 150 and the cylindrical movable electrode 250 are generally cylinder-shaped, and identical in shape and operation to the conventional ones as shown in FIG. 1. Therefore, the cylindrical fixed electrode 150 and the cylindrical movable electrode 250 are schematically depicted, differently from the exact embodiment as shown in FIG. 5.

On the other hand, the wheel-shaped fixed electrode 140 is wheel-shaped, and includes: a cylindrical member 145 having a through hole 143 at its center portion, the protrusion 151 of the cylindrical fixed electrode 150 being vertically inserted into the through hole 143; four spoke members 141 extended in four radial directions from the cylindrical member 145; and a ring-shaped rim member 142 connected in a single body to one sides of the four spoke members 141.

Here, the four spoke members 141 are formed having an interval of 90 degrees from each adjacent spoke member 141.

In addition, it is advantageous that the wheel-shaped fixed electrode 140 consists of a conductor material, such as deoxidized copper.

When the current flows from the cylindrical fixed electrode 150 to the wheel-shaped fixed electrode 140, the spoke members 141 become electrically conductive paths in a radial direction, respectively. The pair of adjacent spoke members form a horizontal loop of electrically conductive path, together with the rim member 142 connected to their edge portions and providing a ring-shaped electrically conductive path.

Each loop of electrically conductive path is indicated by arrows in FIG. 6. The four loops of electrically conductive path are formed according to the first embodiment of the present invention.

Accordingly, when the current flows to the wheel-shaped fixed electrode 140, formed are the four vertical magnetic fields passed and extended through the center portions of the four horizontal loops of electrically conductive path.

On the other hand, pin grooves facing toward the cylindrical fixed electrode 150 are formed in a corresponding number on the surface of the rim member 142 facing to the fixed contactor 110 positioned between each pair of adjacent spoke members, in order to receive the four first conductive pins 130.

Advantageously, the pin grooves 144 are positioned at the center portions of each pair of adjacent spoke members where the current is concentrated in the rim member 142. A depth thereof is preferably identical to or greater than a length of an upper protrusion of the first conductive pin 130.

Here, the four first conductive pins 130 respectively include a disc-shaped unit 131, and upper and lower protrusions 132 respectively vertically extended from the disc-shaped unit 131. The upper protrusion is inserted into the pin groove 144, and the lower protrusion is inserted into the pin groove 116 of the fixed contactor 110.

The first conductive pin 130 preferably consists of the conductor such as the deoxidized copper, and serves to provide the conductive path for electrically connecting the wheel-shaped fixed electrode 140 and the fixed contactor 110 so that the current can flow from the wheel-shaped fixed electrode 140 to the fixed contactor 110.

In addition, the first conductive pin 130 distributes the current between the wheel-shaped fixed electrode 140 and the fixed contactor 110. The arc voltage is in proportion to an amount of the current flowing in the contact, and thus the current is distributed by the first conductive pin 130 in order to generate the arc having a low voltage.

On the other hand, when the fixed contactor 110 and the movable contactor 210 are connected, the first reinforcing member 120 is arranged for mechanical reinforcement between the wheel-shaped fixed electrode 140 and the fixed contactor 110, or between the wheel-shaped movable electrode 240 and the movable contactor 210, in order to prevent an impact from being concentrated on the first conductive pins 130.

In addition, the first reinforcing member 120 is generally disc-shaped, and has an insertion hole 121 at its center portion in order to insert the protrusion 151 of the cylindrical fixed electrode 150.

A radius of the first reinforcing member 120 is smaller than that of an inner circumferential surface of the rim member 142, and thus the first reinforcing member 120 is not connected to the first conductive pin 130.

Besides, the stainless steel having a greater electric resistance than the first conductive pin 130 consisting of the deoxidized copper is used as a material of the first reinforcing member 120. Accordingly, the current from the wheel-shaped fixed electrode 140 mostly flows to the fixed contactor 110 through the first conductive pin 130.

On the other hand, the fixed contactor 110 is a disc-shaped conductor, and is electrically and mechanically connected to the wheel-shaped fixed electrode 140 by a plurality of first conductive pins 130.

That is, the upper protrusions 140 of the first conductive pins 130 are inserted respectively into the pin grooves 144 of the wheel-shaped fixed electrode 140, and the lower protrusions thereof are inserted respectively into the pin grooves 116 of the fixed contactor 110, thereby electrically and mechanically connecting the fixed contactor 110 and the wheel-shaped fixed electrode 140.

In addition, as shown in FIG. 6, the fixed contactor 110 is generally disc-shaped, and includes a first face facing to the movable contactor 210, and a second face facing to the wheel-shaped fixed electrode 140.

A first face of the fixed contactor 110 includes: the contact 111 consisting of at least one flat surface for connection with the movable contactor 210; at least one slant surface 112 slanted in order not to be connected to the movable contactor 210 so that a separation speed can be improved when separated from the movable contactor 210; and a groove 113 formed at the center portion of the contact 111 in order to prevent the arc from being generated at the center portion. A second face of the fixed contactor 110 consists of a flat surface.

Also, the fixed contactor 110 includes electrically conductive paths 115 having a predetermined thickness from the rim to the center, and is provided with four pairs of parallel linear slits 114 in order to prevent the current from going round.

The pin grooves 116 for receiving the lower protrusions of the first conductive pins 130 are respectively formed at regions of the electrically conductive paths 115 formed by each pair of the linear slits 114, which are adjacent to an outer circumferential surface of the fixed contactor 110.

The slits 114 serve to divide the electrically conductive paths 115, and to interrupt a movement path of an eddy current in order for the eddy current not to offset the vertical magnetic field when it is being formed.

On the other hand, as depicted in FIG. 6, the movable contactor 210 facing to the fixed contactor 110 is formed in an identical shape to the fixed contactor 110.

That is, a first face of the movable contactor 210 includes: the contact 211 consisting of at least one flat surface for connection with the fixed contactor 110; at least one slant surface 212 slanted in order not to be connected to the fixed contactor 110 so that a separation speed can be improved when separated from the fixed contactor 110; and a groove 213 formed at the center portion of the contact 211 in order to prevent the arc from being generated at the center portion. As shown in FIG. 6, a second face of the movable contactor 210 generally consists of a flat surface.

The movable contactor 210 also includes the electrically conductive paths 215 having a predetermined thickness from the rim to the center, and is provided with four pairs of parallel linear slits 214 in order to prevent the current from going round.

The pin grooves 216 for receiving the lower protrusions of the second conductive pins 230 are respectively formed at regions of the electrically conductive paths 215 formed by each pair of the linear slits 214, which are adjacent to an outer circumferential surface of the movable contactor 210.

The slits 214 serve to divide the electrically conductive paths 215, and to interrupt the movement path of the eddy current in order for the eddy current not to offset the vertical magnetic field when it is being formed.

On the other hand, when the fixed contactor 110 and the movable contactor 210 are connected, the second reinforcing member 220 is arranged for mechanical reinforcement between the wheel-shaped movable electrode 240 and the movable contactor 210, in order to prevent an impact from being concentrated on the second conductive pins 230.

The second reinforcing member 220 is generally disc-shaped, and includes the insertion hole 221 at its center portion for inserting the protrusion 251 of the cylindrical movable electrode 250.

A radius of the second reinforcing member 220 is smaller than that of an inner circumferential surface of the rim member 242, and thus the second reinforcing member 220 is not connected to the second conductive pin 230.

Besides, the stainless steel having a greater electric resistance than the second conductive pin 230 consisting of the deoxidized copper is used as a material of the second reinforcing member 220. Accordingly, the current from the movable contactor 210 mostly flows to the wheel-shaped movable electrode 240 through the second conductive pin 230.

The four second conductive pins 230 respectively include a disc-shaped unit 231, and upper and lower protrusions 232 respectively vertically extended from the disc-shaped unit 231. The lower protrusion is inserted into the pin groove 244 of the wheel-shaped movable electrode 240, and the upper protrusion is inserted into the pin groove 216 of the movable contactor 210.

The second conductive pin 230 preferably consists of the conductor such as the deoxidized copper, and serves to provide the conductive path for electrically connecting the wheel-shaped movable electrode 240 and the movable contactor 210 so that the current can flow from the movable contactor 210 to the wheel-shaped movable electrode 240.

In addition, the second conductive pin 230 distributes the current between the movable contactor 210 and the wheel-shaped movable electrode 240.

That is, the arc voltage is in proportion to an amount of the current flowing in the contact, and thus the current is distributed by the second conductive pin 230 in order to generate the arc having a low voltage.

The wheel-shaped movable electrode 240 is wheel shaped, and includes: a cylindrical member 245 having a through hole 243 at its center portion, the protrusion 251 of the cylindrical movable electrode 250 being vertically inserted into the through hole 243; four spoke members 241 extended in four radial directions from the cylindrical member 245; and a ring-shaped rim member 242 connected in a single body to one sides of the four spoke members 241.

Here, the four spoke members 241 are formed having an interval of 90 degrees from each adjacent spoke member 241.

In addition, it is advantageous that the wheel-shaped movable electrode 240 consists of the conductor material, such as the deoxidized copper.

When the current flows from the movable contactor 210 to the wheel-shaped movable electrode 240 via the second conductive pin 230, the spoke members 241 become electrically conductive paths in a radial direction, respectively. The pair of adjacent spoke members form a horizontal loop of electrically conductive path, together with the rim member 242 connected to their edge portions and providing a ring-shaped electrically conductive path.

Each loop of electrically conductive path is indicated by arrows in FIG. 6. The four horizontal loops of electrically conductive path are formed according to the first embodiment of the present invention.

Accordingly, when the current flows to the wheel-shaped movable electrode 240, formed are the four vertical magnetic fields passed and extended through the center portions of the four horizontal loops of electrically conductive path.

In addition, pin grooves facing toward the cylindrical movable electrode 250 are formed in a corresponding number on a surface of the rim member 242 facing to the movable contactor 210 positioned between each pair of adjacent spoke members, in order to receive the four second conductive pins 230.

Here, the pin grooves 244 are advantageously positioned at the center portions of each pair of adjacent spoke members where the current is concentrated in the rim member 242. A depth thereof is preferably identical to or greater than a length of a lower protrusion of the second conductive pin 230.

On the other hand, the assembly method of the interrupter for the circuit breaker in accordance with the first embodiment of the present invention will now be explained.

The first reinforcing member 120 is positioned between the wheel-shaped fixed electrode 140 and the fixed contactor 110. Thereafter, the lower protrusions of the four first conductive pins 130 are inserted respectively into the pin grooves 116 of the fixed contactor 110, and the upper protrusions thereof are inserted into the pin grooves 144 formed on the surface of the wheel-shaped fixed electrode 140 facing to the first reinforcing member 120.

The protrusion 151 of the cylindrical fixed electrode 150 is positioned toward a lower direction, passed through the through hole 143 of the wheel-shaped fixed electrode 140, and inserted into the insertion hole 121 of the first reinforcing member 120, thereby finishing the assembly of the electrode at the fixed side.

In the assembly of the electrode at the movable side, the second reinforcing member 220 is firstly positioned between the wheel-shaped movable electrode 240 and the movable contactor 210. The upper protrusions of the four second conductive pins 230 are inserted respectively into the pin grooves 216 of the movable contactor 210, and the lower protrusions thereof are inserted into the pin grooves 244 formed on the surface of the wheel-shaped movable electrode 240 facing to the second reinforcing member 230.

The protrusion 251 of the cylindrical movable electrode 250 is positioned toward an upper direction, passed through the through hole 243 of the wheel-shaped movable electrode 240, and inserted into the insertion hole 221 of the second reinforcing member 220, thereby finishing the assembly of the electrode at the movable side.

On the other hand, in order to prevent the vertical magnetic fields of the wheel-shaped movable electrode 240 from being overlapped with those of the wheel-shaped fixed electrode 140, and to form the plurality of vertical magnetic fields, the plurality of spoke members 241 of the wheel-shaped movable electrode 240 are correspondingly alternatively arranged having a predetermined angular difference from the plurality of spoke members of the fixed member 140.

According to the first embodiment of the present invention, the predetermined angular difference is advantageously 45 degrees.

The assembly of the units which are not described above is identical to the conventional art as depicted in FIGS. 1 to 4, and thus explanation thereof is omitted.

The operation of the interrupter for the circuit breaker in accordance with the first embodiment of the present invention will now be explained.

When the interrupter according to the present invention is turned on, if the cylindrical movable electrode 250 is moved to an upper direction in FIG. 6 by an actuator mechanism (not shown), the movable contactor 210 is moved and connected to the fixed contactor 110.

Here, in case the input current li flows to the cylindrical fixed electrode 150 via the fixed terminal 34 connected to the power source, the input current li flows to the wheel-shaped fixed electrode 140 via the body portion and the protrusion 151 of the cylindrical fixed electrode 150.

Thereafter, the input current li flows from the wheel-shaped fixed electrode 140 to the fixed contactor 110 via the first conductive pin 130.

The input current li flows from the fixed contactor 110 to the wheel-shaped movable electrode 240 via the movable contactor 210 and the second conductive pin 230, and becomes the output current lo outputted through the cylindrical movable electrode 250 from the wheel-shaped movable electrode 240.

Then, the output current lo is supplied to the load side (not shown).

On the other hand, in a state where the contactors 110, 210 of the two electrodes 140, 240 are connected, namely the interrupter is turned on, if the abnormal current flows from the electrode at the fixed side to the electrode at the movable side, or vise versa, the cylindrical movable electrode 250 is moved to a lower direction in said Figure by the link connected to the trip mechanism operated when a large current is generated.

Therefore, the movable contactor 210 is separated from the fixed contactor 110, thereby interrupting the electrical connection of the power source side and the load side.

When the movable contactor 210 is separated from the fixed contactor 110, namely the interrupter is turned off, the vertical arc is generated between the contacts 111, 211 of the contactors 110, 210.

The wheel-shaped movable electrode 240 and the wheel-shaped fixed electrode 140 are wheel-shaped conductors respectively having the spoke members 141, 241 and the rim members 142, 242. When the current flows to the electrodes 140, 240, the plurality of vertical magnetic fields are formed in parallel with a generation direction of the arc by the plurality of horizontal loops of electrically conductive path consisting of the spoke members 141, 241 and the rim members 142, 242.

The plurality of vertical magnetic fields in parallel with the generation direction of the arc distribute the arc not to be concentrated on a single point, and interrupt the movement of the arc by shutting it between the adjacent vertical magnetic fields, thereby rapidly extinguishing the arc at a low voltage.

Accordingly, the contact is not melted due to the generation of a high arc voltage resulting from the concentration of the arc. In addition, the melting line is not generated at the contact due to the movement of the concentrated arc.

When the current is supplied from the wheel-shaped fixed electrode 140 to the fixed contactor 110, the current flowing through the plurality of first conductive pins 130 is provided by a quarter of the current flowing to the wheel-shaped fixed electrode 140, and thus the current identically flows to the electrically conductive path 115 of the fixed contactor 110.

In a state where the movable contactor 210 and the fixed contactor 110 are connected, the current as much as a quarter of the current flowing to the wheel-shaped fixed electrode 140 flows to the electrically conductive path 215 of the movable contactor 210.

The arc voltage generated on the surfaces of the two electrically conductive paths 115, 215 facing to the contacts of the two contactors 110, 210 when the contactors 110, 210 are separated is in proportion to an amount of the current flowing to the contacts, and thus it is reduced to a quarter of the arc voltage when the current flowing to the contacts flows together.

As the arc voltage is reduced, the arc of the electrodes 140, 240 is distributed, and its movement is interrupted. Furthermore, the contactors 110, 210 and the electrodes 140, 240 are decreased in size, and the arc shield members 51, 52 are reduced in thickness. As a result, the interrupter can be reduced in size.

Figure 7A:
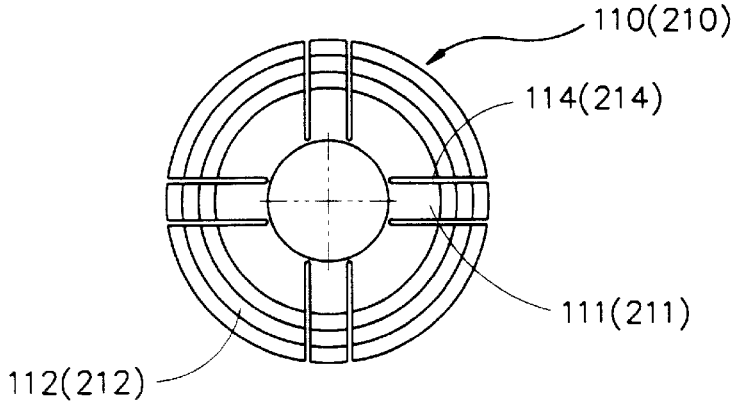
FIG. 7A is a plan view illustrating a contactor of the interrupter in accordance with the first embodiment of the present invention.
Figure 7B:
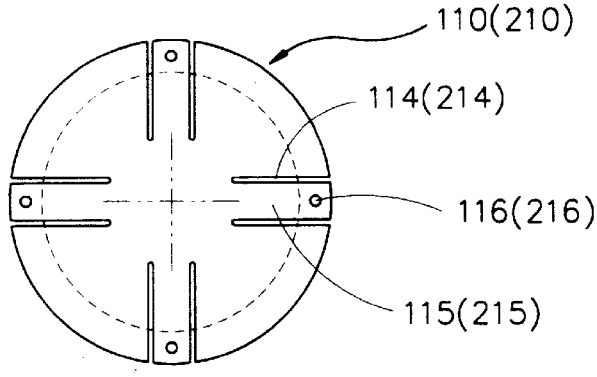
FIG. 7B is a bottom view illustrating a contactor of the interrupter in accordance with the first embodiment of the present invention.

On the other hand, FIGS. 7A and 7B are a plan view and a bottom view respectively illustrating the fixed contactor 110 and the movable contactor 210.

Reference numerals without parentheses depict major units of the fixed contactor 110, and reference numerals inside the parentheses indicate corresponding units of the movable contactor 210.

Referring to FIGS. 7A and 7B, reference numerals 110 and 210 depict the fixed contactor and the movable contactor, respectively. Reference numerals 114 and 214 indicate the pairs of slits of the fixed contactor 110 and the movable contactor 210, respectively. Reference numerals 115 and 215 are respectively the electrically conductive paths of the fixed contactor 110 and the movable contactor 210. Reference numerals 116 and 216 respectively depict the insertion holes where the first conductive pins 130 and the second conductive pins 230 are inserted.

As shown in FIGS. 7A and 7B, the silts 114, 214 are formed, extended horizontally from the outer surfaces of the contactors 110, 210 adjacently to the circumferential portions of the grooves 113, 213 in FIG. 6.

Figure 8:
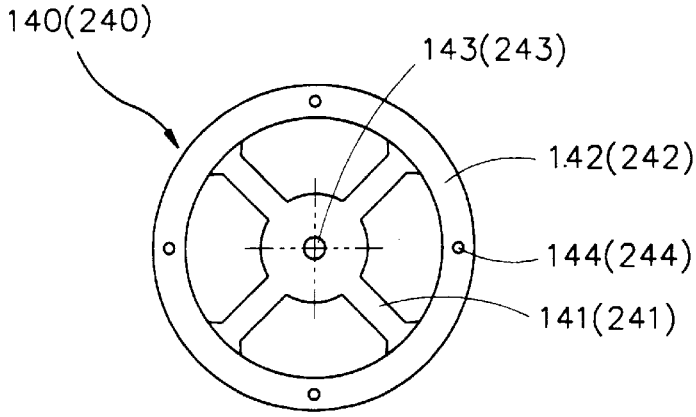
FIG. 8 is a plan view illustrating a wheel-shaped movable electrode of the interrupter, and a bottom view illustrating a wheel-shaped fixed electrode thereof in accordance with the first embodiment of the present invention.

FIG. 8 is a bottom view illustrating the wheel-shaped fixed electrode of the interrupter, and a plan view illustrating the wheel-shaped movable electrode thereof in accordance with the first embodiment of the present invention. Reference numerals without parentheses depict major units of the wheel-shaped fixed electrode 140, and reference numerals inside the parentheses depict corresponding unit of the wheel-shaped movable electrode 240.

In addition, reference numerals 141 and 241 respectively indicate the four spoke members of the wheel-shaped fixed electrode 140 and the four spoke members of the wheel-shaped movable electrode 240. Reference numerals 142 and 242 depict the rim member of the wheel-shaped fixed electrode 140 and the rim member of the wheel-shaped movable electrode 240, respectively. Reference numerals 143 and 243 are respectively the through hole which the protrusion 151 of the cylindrical fixed electrode 150 is passed through, and the through hole which the protrusion 251 of the cylindrical movable electrode 250 is passed through.

The four pin grooves 144 of the wheel-shaped fixed electrode 140 and the pin grooves 244 of the wheel-shaped movable electrode 240 are grooves where the first conductive pins 130 and the second conductive pins 230 are respectively inserted.

Figure 9:
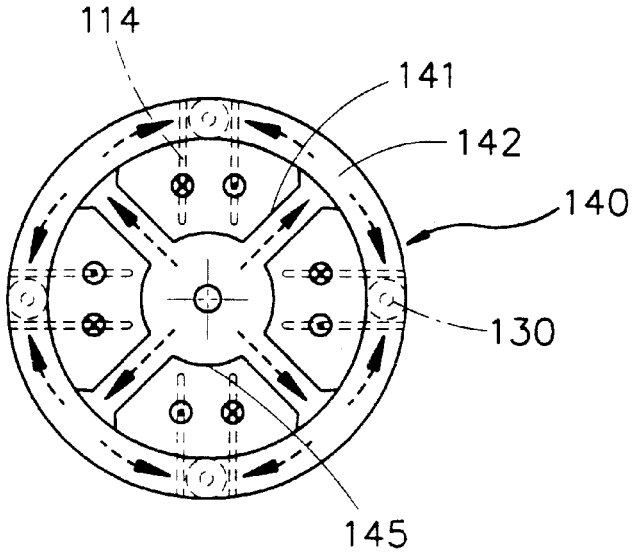
FIG. 9 is a plan view illustrating the current flowing and magnetic field formation of the fixed electrode, when a current flows from the fixed electrode to the movable electrode in the interrupter in accordance with the first embodiment of the present invention.
Figure 10:
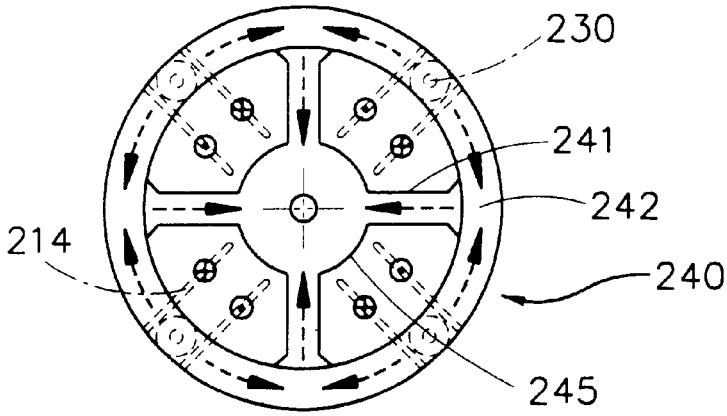
FIG. 10 is a plan view illustrating the current flowing and magnetic field formation of the movable electrode, when a current flows from the fixed electrode to the movable electrode in the interrupter in accordance with the first embodiment of the present invention.

FIG. 9 is a plan view illustrating the current flowing and magnetic field formation of the fixed electrode, when the current flows from the fixed electrode to the movable electrode in the interrupter in accordance with the first embodiment of the present invention. FIG. 10 is a plan view illustrating the current flowing and magnetic field formation of the movable electrode, when the current flows from the fixed electrode to the movable electrode in the interrupter in accordance with the first embodiment of the present invention.

The formation of the horizontal loop of the current and the formation of the vertical magnetic field in the electrodes 140, 240 in accordance with the first embodiment of the present invention will now be further explained with reference to FIGS. 9 and 10.

When the current is supplied to the cylindrical member 145 of the wheel-shaped fixed electrode 140 through the protrusion 151 of the cylindrical fixed electrode 150, the supplied current is divided into four by the four spoke members 141, and thus flows to the rim member 142 as indicated by the arrows.

The current reaching to the rim member 142 is divided into two. As a result, the current as much as one eighth of the current supplied through the protrusion 151 flows toward the first conductive pins 130 adjacent to each spoke members 141 (refer to the arrows).

Accordingly, the current flowing to the first conductive pin 130 is a sum of the two currents divided into eight, and thus the current corresponding to a quarter of the current supplied through the protrusion 151 flows.

As illustrated in FIG. 9, the horizontal current loop is formed by the pair of adjacent spoke members 141,141 and the rim member 142 connected to the radial edge portions of the spoke members 141, 141. Consequently, the four horizontal current loops are formed.

Therefore, the vertical magnetic fields are formed in a vertical direction passing through the center portions of each horizontal current loop.

The vertical magnetic field forms a vertical loop entering at a right angle to said Figure, as indicated by the mark "⊗", and going out at a right angle to said Figure, as indicated by the mark "⊙".

Thereafter, when the current divided into four is supplied to the rim member 242 of the wheel-shaped movable electrode 240 through the second conductive pin 230, the current reaching to the rim member 242 is divided into two, as indicated by the arrows in FIG. 10, and thus the current divided into eight flows through the rim member 242.

The currents divided by eight flow by twos, and thus the current flowing to each spoke member 241 corresponds to the quarter of the firstly supplied current.

Thereafter, as shown in said Figure, the currents divided into four are concentrated on the center of the wheel-shaped movable electrode 240, and thus the current as much as the supplied current flows through the protrusion 251 of the cylindrical movable electrode 250.

Here, as depicted in FIG. 10, the horizontal current loop is formed by the pair of adjacent spoke members 241, 241 and the rim member 242 connected to the radial edge portions of the spoke members 241, 241. As a result, the four horizontal current loops are formed.

Therefore, the vertical magnetic fields are formed in a vertical direction passing through the center portions of each horizontal current loop.

The vertical magnetic field forms a vertical loop entering at a right angle to said Figure, as indicated by the mark "⊗", and going out at a right angle to said Figure, as indicated by the mark "⊙".

On the other hand, an interrupter for a circuit breaker in accordance with another embodiment of the present invention will now be described with reference to FIG. 11.

Figure 11:
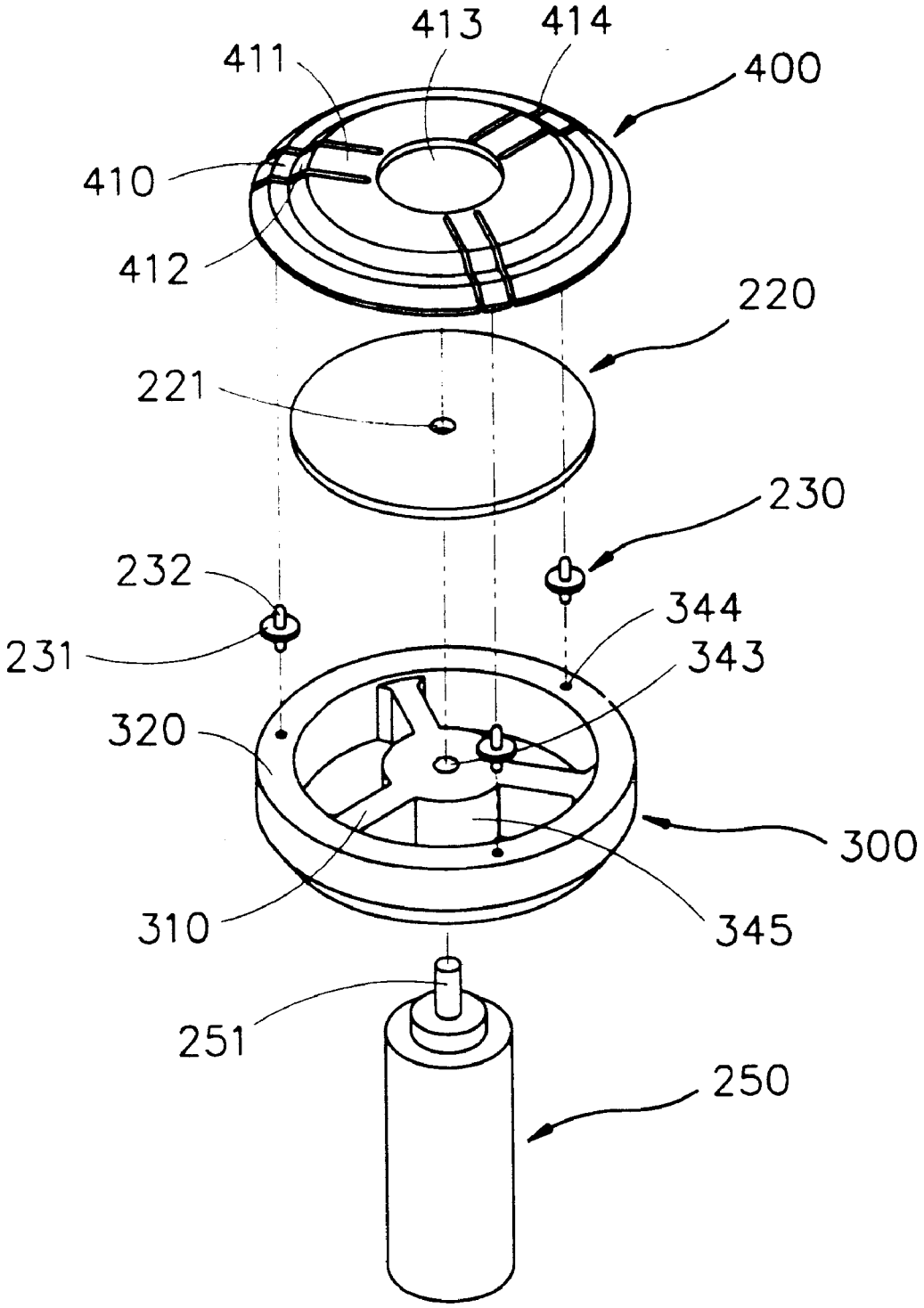
FIG. 11 is an exploded perspective view illustrating a structure of an electrode of an interrupter in accordance with another embodiment of the present invention.

FIG. 11 is an exploded perspective view illustrating a structure of the electrode of the interrupter in accordance with another embodiment of the present invention.

FIG. 11 merely depicts a movable contactor and a movable electrode of the interrupter for the circuit breaker according to another embodiment of the present invention. However, a fixed contactor and a fixed electrode are not different at all in constitution and effect from the movable contactor and the movable electrode, except that they are symmetrically provided facing to each other, and thus are not illustrated.

In addition, the identical constitution and operation to the first embodiment of the present invention as shown in FIGS. 5 to 10 will not be explained.

Referring to FIG. 11, the movable contactor 400 has a first face facing to the movable electrode 300, and a second face facing to the fixed contactor (not shown).

The first face of the movable contactor 400 is generally a flat surface, and its second face includes: a contact 411 consisting of at least one flat surface for connection with a flat surface of the fixed contactor (not shown); at least one slant surface 412 slanted in order not to be connected to the fixed contactor (not shown) so that a separation speed can be improved when separated from the fixed contactor (not shown), by reducing a connection area with the fixed contactor (not shown); and a groove 413 formed at a center portion of the contact 411 in order to prevent the arc from being generated at the center portion.

Also, the movable contactor 400 includes electrically conductive paths 410 having a predetermined length from the rim to the center, and is provided with three pairs of parallel linear slits 414 in order to prevent the current from going round.

Pin grooves (not shown) for receiving upper protrusions of second conductive pins 230 are respectively formed at regions of the electrically conductive paths 410 formed by each pair of the linear slits 114, which are adjacent to an outer circumferential surface of the movable contactor 400.

The slits 414 serve to divide the electrically conductive paths 410, and to interrupt a movement path of an eddy current in order for the eddy current not to offset the vertical magnetic field when it is being formed.

On the other hand, when the fixed contactor (not shown) and the movable contactor 400 are connected, a reinforcing member 220 is arranged for mechanical reinforcement between the fixed electrode (not shown) and the movable contactor 400 in order to prevent an impact from being concentrated on second conductive pins 230.

The reinforcing member 220 is generally disc-shaped, and has an insertion hole 221 at its center portion in order to insert a protrusion 251 of a cylindrical movable electrode 250.

A radius of the reinforcing member 220 is smaller than that of an inner circumferential surface of a rim member 320, and thus the reinforcing member 220 is not connected to the second conductive pin 230.

Besides, a stainless steel having a greater electric resistance than the second conductive pin 230 consisting of a deoxidized copper is used as a material of the reinforcing member 220. Accordingly, the current from the movable contactor 400 mostly flows to the movable electrode 300 through the second conductive pin 230.

On the other hand, the three second conductive pins 230 consist of one disc-shaped unit 231, and protrusions 232 protruded from the disc-shaped unit 231 to upper and lower directions, respectively. The upper protrusions are inserted into the pin grooves (not shown) of the movable contactor 400.

The second conductive pin 230 preferably consists of the conductor such as the deoxidized copper, and serves to provide a conductive path for electrically connecting the movable electrode 300 and the movable contactor 400 so that the current can flow from the movable contactor 400 to the movable electrode 300.

In addition, the second conductive pin 230 distributes the current between the movable contactor 400 and the movable electrode 400.

That is to say, the arc voltage is in proportion to an amount of the current flowing in the contact, and thus the current is distributed by the plurality of second conductive pins 230 in order to generate the arc having a low voltage.

On the other hand, the movable electrode 300 is wheel-shaped, and includes: a cylindrical member 345 having a through hole 343 at its center portion, the protrusion 251 of the cylindrical movable electrode 250 being vertically inserted into the through hole 343; three spoke members 310 extended in three radial directions from the cylindrical member 345; and a ring-shaped rim member 320 connected in a single body to edge portions of the three spoke members 310.

Here, the three spoke members 310 are formed having an interval of 120 degrees from each adjacent spoke member 310.

In addition, it is advantageous that the movable electrode 300 consists of a conductor material, such as the deoxidized copper.

When the current flows from the movable contactor 400 to the movable electrode 300 through the second conductive pin 230, the spoke members 141 become the electrically conductive paths in a radial direction, respectively. The pair of adjacent spoke members form a horizontal loop of electrically conductive path, together with the rim member 320 connected to their edge portions and providing a ring-shaped electrically conductive path.

The three loops of electrically conductive path are formed according to another embodiment of the present invention.

Accordingly, when the current flows to the movable electrode 300, formed are the three vertical magnetic fields passed and extended through the center portions of the three horizontal loops of electrically conductive path.

On the other hand, pin grooves 344 facing toward the cylindrical movable electrode 250 are formed in a corresponding number on the surface of the rim member 320 facing to the movable electrode 400 positioned between each pair of adjacent spoke members 310, 310, in order to receive the three second conductive pins 230.

Advantageously, the pin grooves 344 are positioned at the center portions of each pair of adjacent spoke members 310, 310 where the current is concentrated in the rim member 320. A depth thereof is preferably identical to or greater than a length of the lower protrusion of the second conductive pin 230.

On the other hand, the assembly method of the interrupter for the circuit breaker in accordance with another embodiment of the present invention will now be explained with reference to FIG. 11.

The reinforcing member 220 is positioned between the movable electrode 300 and the movable contactor 400. Thereafter, the upper protrusions of the three second conductive pins 230 are inserted respectively into the pin grooves (not shown) of the movable contactor 400, and the lower protrusions thereof are inserted into the pin grooves 344 of the movable electrode 300.

The protrusion 251 of the cylindrical movable electrode 250 is positioned to an upper direction, namely toward the movable electrode 300, passed through the through hole 343 of the movable electrode 300, and inserted into the insertion hole 221 of the reinforcing member 220, thereby finishing the assembly of the movable electrode and the movable contactor.

In the assembly of the electrode at the movable side, the second reinforcing member 220 is firstly positioned between the wheel-shaped movable electrode 240 and the movable contactor 210. The upper protrusions of the four second conductive pins 230 are inserted respectively into the pin grooves 216 of the movable contactor 210, and the lower protrusions thereof are inserted into the pin grooves 244 formed on the surface of the wheel-shaped movable electrode 240 facing to the second reinforcing member 230.

The protrusion 251 of the cylindrical movable electrode 250 is positioned toward an upper direction, passed through the through hole 243 of the wheel-shaped movable electrode 240, and inserted into the insertion hole 221 of the second reinforcing member 220, thereby finishing the assembly of the electrode at the movable side.

On the other hand, in order to prevent the vertical magnetic fields of the movable electrode 300 from being overlapped with those of the fixed electrode, and to form the plurality of vertical magnetic fields, the spoke members 310 of the movable electrode 300 are respectively alternatively arranged having a predetermined angular difference from the spoke members (not shown) of the fixed member (not shown).

According to another embodiment of the present invention, the predetermined angular difference is advantageously 60 degrees.

The assembly method of the fixed contactor and the fixed electrode is identical to that of the movable contactor and the movable electrode as shown in FIG. 11, and thus explanation thereof is omitted.

On the other hand, the operation of the interrupter for the circuit breaker in accordance with another embodiment of the present invention will now be explained.

Identically to the operation of the first embodiment of the present invention as described above, when the interrupter for the circuit breaker is turned on, if the cylindrical movable electrode 250 is moved to an upper direction in FIG. 11 by an actuator mechanism (not shown), the movable contactor 400 is moved and connected to the fixed contactor (not shown).

Here, in case an input current flows to the fixed electrode (not shown) via a fixed terminal (not shown) connected to the power source, the input current flows to a wheel-shaped fixed electrode (not shown) through the fixed electrode (not shown).

Thereafter, the input current flows from the wheel-shaped fixed electrode (not shown) to the fixed contactor (not shown) via the first conductive pin (not shown).

The input current flows from the fixed contactor (not shown) to the movable electrode 300 through the movable contactor 400 and the second conductive pin 230, and becomes an output current outputted through the cylindrical movable electrode 250 from the movable electrode 300.

Then, the output current is supplied to a load side (not shown).

On the other hand, in a state where the fixed contactor (not shown) and the movable contactor 400 are connected, namely the interrupter is turned on, if the abnormal current flows from the electrode at the fixed side to the electrode at the movable side, or vise versa, the cylindrical movable electrode 250 is moved to a lower direction in said Figure by the link connected to the trip mechanism operated when a large current is generated.

Therefore, the movable contactor 400 is separated from the fixed contactor (not shown), thereby interrupting the electrical connection of the power source side and the load side.

When the fixed contactor (not shown) is separated from the movable contactor 400, namely the interrupter is turned off, the vertical arc is generated between the contacts of the fixed and movable contactors.

Thus, the movable electrode 300 and the fixed electrode (not shown) are wheel-shaped conductors respectively having the spoke members and the rim members. When the current flows to the electrodes, the plurality of vertical magnetic fields are formed in parallel with a generation direction of the arc by the plurality of horizontal loops of electrically conductive path consisting of the spoke members 310 and the rim members 320.

The plurality of vertical magnetic fields in parallel with the generation direction of the arc evenly distribute the arc not to be concentrated on a single point, and interrupt the movement of the arc by shutting it between the adjacent vertical magnetic fields, thereby rapidly extinguishing the arc at a low voltage.

Accordingly, the contact is not melted due to the generation of a high arc voltage resulting from the concentration of the arc. In addition, the melting line is not generated at the contact due to the movement of the concentrated arc.

When the current is supplied from the fixed electrode (not shown) to the fixed contactor (not shown), the current is provided by a third of the current flowing to the fixed electrode (not shown) through the plurality of first conductive pins (not shown), and thus the current identically flows to the electrically conductive path of the fixed contactor.

In a state where the movable contactor 400 and the fixed contactor (not shown) are connected, the current as much as a third of the current flowing to the fixed electrode flows to the electrically conductive path 410 of the movable contactor 400.

The arc voltage generated between the contacts of the fixed contactor (not shown) and the movable contactor 400 when the contactors are separated is in proportion to an amount of the current flowing to the contacts, and thus it is reduced to a third of the arc voltage when the current flowing to the contacts flows together.

As the arc voltage is reduced, the arc of the electrodes is distributed, and its movement is interrupted. Furthermore, the contactors and the electrodes are decreased in size, and the arc shield members are reduced in thickness. As a result, the interrupter can be reduced in size.

Figure 12:
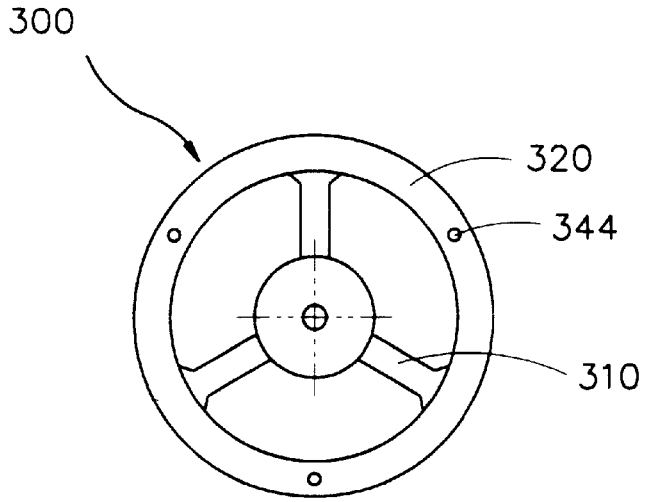
FIG. 12 is a plan view illustrating a wheel-shaped electrode of the interrupter in accordance with another embodiment of the present invention.

FIG. 12 is a plan view illustrating the wheel-shaped movable electrode in accordance with another embodiment of the present invention.

A bottom surface of the wheel-shaped fixed electrode is identical to a flat surface of the wheel-shaped movable electrode 300.

Reference numeral 300 depicts the wheel-shaped movable electrode, and reference numeral 310 indicates the three spoke members of the movable electrode 310.

Reference numeral 320 depicts the rim member. The three pin grooves 344 of the movable electrode 300 are grooves where the second conductive pins 230 are inserted.

The formation of the horizontal loop of the current and the formation of the vertical magnetic field in the electrode in accordance with another embodiment of the present invention will now be explained with reference to FIG. 13.

In order to avoid redundancy, a wheel-shaped fixed electrode 500 will now be exemplified, and the illustration and explanation of the movable electrode 300 will not be omitted.

When the current is supplied to the cylindrical member 545 of the wheel-shaped fixed electrode 500 through the fixed electrode (not shown), the supplied current is divided into three by the three spoke members 510, and thus flows to the rim member 520 as indicated by the arrows.

The current reaching to the rim member 520 is divided into two. As a result, the current as much as one sixth of the current supplied through the fixed electrode (not shown)

flows toward the first conductive pins 130 adjacent to each spoke members 510 (refer to the arrows).

Accordingly, the current flowing to each first conductive pin 130 is a sum of the two currents divided into six, and thus the current corresponding to one third of the current supplied through the fixed electrode (not shown) flows.

Figure 13:
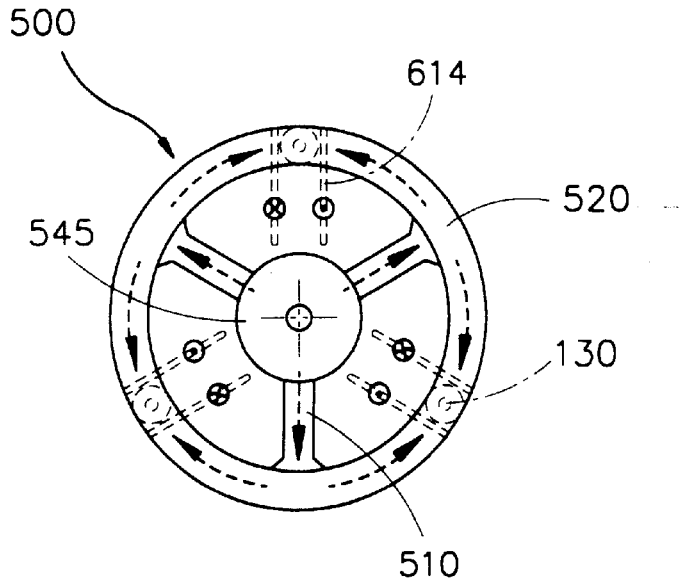
FIG. 13 is a plan view illustrating the current flowing and magnetic field formation of a fixed electrode, when a current flows from the fixed electrode to a movable electrode in the interrupter in accordance with another embodiment of the present invention.

As illustrated in FIG. 13, the horizontal current loop is formed by the pair of adjacent spoke members 510, 510 and the rim member 520 connected to the edge portions of the spoke members 510, 510. Consequently, the three horizontal current loops are formed.

Therefore, the vertical magnetic fields are formed in a vertical direction passing through the center portions of each horizontal current loop.

The vertical magnetic field forms a vertical loop entering at a right angle to said Figure, as indicated by the mark "⊗", and going out at a right angle to said Figure, as indicated by the mark "⊙".

Reference numeral 614 depicts the slits formed in the fixed contactor (not shown).

As discussed earlier, the interrupter for the circuit breaker in accordance with the present invention can distribute the arc generated when the movable contactor is separated from the fixed contactor in interrupting a large current, by forming the plurality of vertical magnetic fields in parallel with the arc, and can prevent the contact from being melted and the melting line from being generated due to the concentration and movement of the arc, by shutting the arc between the pair of adjacent magnetic fields.

In addition, the current is dividedly supplied through the plurality of electrically conductive paths to the plurality of contacts which are separated from one another on the first contactor, and the plurality of vertical magnetic fields are applied. Thus, the arc is distributed, and its voltage is reduced. As a result, the arc is rapidly distinguished, thereby decreasing loss of the contact, improving circuit breaking performance, and increasing an interruption amount.

Furthermore, the interrupter for the circuit breaker according to the present invention has an improved interruption performance of the abnormal current, as compared with the conventional interrupter, and is reduced in size, which results in reduced fabrication cost.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An interrupter for a circuit breaker, comprising:

a fixed electrode including a plurality of horizontal loops of electrically conductive paths for forming a plurality of vertical magnetic fields;

a fixed contactor being electrically connected to the fixed electrode;

a movable electrode including a plurality horizontal loops of electrically conductive paths for forming a plurality of vertical magnetic fields;

a movable contactor being electrically connected to the movable electrode, and being movable to be connected to the fixed contactor for electrical connection with the fixed contactor, or to be separated from the fixed contactor in order to interrupt electrical connection with the fixed contactor;

a plurality of first conductive pin members being connected between the fixed electrode and the fixed contactor for electrically connecting the fixed electrode to the fixed contactor and for dividing a flow of current therebetween;

a plurality of second conductive pin members being connected between the movable electrode and the movable contactor for electrically connecting the movable electrode to the movable contactor and for dividing the flow of current therebetween; and a mechanical reinforcing member arranged between the fixed electrode and the fixed contactor or between the movable electrode and the movable contactor, for preventing an impact from being concentrated on the first conductive pin members or the second conductive pin members, when the movable contactor is in contact with the fixed contactor.

2. The interrupter for the circuit breaker according to claim 1, wherein the fixed electrode comprises:

a ring-shaped conductive member for providing a ring-shaped conductive path where the current flows;

a plurality of spoke-shaped conductive members being connected to the ring-shaped conductive member for providing radial conductive paths where the current flows; and a plurality of horizontal loops of electrically conductive path being formed by the pair of spoke-shaped conductive members and the ring-shaped conductive member for forming the plurality of vertical magnetic fields.

3. The interrupter for the circuit breaker according to claim 1, wherein the movable electrode comprises:

a ring-shaped conductive member for providing a ring-shaped conductive path where the current flows;

a plurality of spoke-shaped conductive members being connected to the ring-shaped conductive member for providing radial conductive paths where the current flows; and a plurality of horizontal loops of electrically conductive path being formed by the pair of spoke-shaped conductive members and the ring-shaped conductive member for forming the plurality of vertical magnetic fields.

4. The interrupter for the circuit breaker according to either claim 2 or 3, wherein the spoke-shaped conductive members of the movable electrode are correspondingly alternatively arranged having a predetermined angular difference from the spoke-shaped members of the fixed member, in order to prevent the vertical magnetic fields of the movable electrode from being overlapped with those of the fixed electrode.

5. The interrupter for the circuit breaker according to claim 4, wherein the plurality of spoke-shaped conductive members of the fixed electrode are four spoke-shaped conductive members arranged at an interval of 90 degrees, respectively; the number of the plurality of horizontal loops of electrically conductive path of the fixed electrode is four; the plurality of spoke-shaped conductive members of the movable electrode are four spoke-shaped conductive members arranged at an interval of 90 degrees, respectively; the number of the plurality of horizontal loops of electrically conductive path of the movable electrode is four; and the predetermined angular difference is 45 degrees.

6. The interrupter for the circuit breaker according to claim 4, wherein the plurality of spoke-shaped conductive members of the fixed electrode are three spoke-shaped conductive members arranged at an interval of 120 degrees, respectively; the number of the plurality of horizontal loops of electrically conductive path of the fixed electrode is three; the plurality of spoke-shaped conductive members of the movable electrode are three spoke-shaped conductive members arranged at an interval of 120 degrees, respectively; the number of the plurality of horizontal loops of electrically conductive path of the movable electrode is three; and the predetermined angular difference is 60 degrees.

7. The interrupter for the circuit breaker according to claim 1, wherein the reinforcing member consists of a material having a remarkably greater electric resistance than the first conductive pin member or the second conductive pin member, in order for the current to flow merely through the first conductive pin member or the second conductive pin member.

8. The interrupter for the circuit breaker according to claim 7, wherein the reinforcing member consists of stainless steel, and the first or second conductive pin member consists of deoxidized copper.

9. The interrupter for the circuit breaker according to claim 1, wherein the fixed contactor is a disc-shaped conductor having a face facing to the movable contactor, the face comprising:

at least one flat surface for connecting the movable contactor;

at least one slant surface being slanted in order not to be connected to the movable contactor so that a separation speed can be improved when separated from the movable contactor;

a groove being formed at a center portion in order to prevent the arc from being generated at the center portion; and several pairs of linear slits forming a plurality of linear current paths, and being formed in parallel having a predetermined length from the rim, in order to prevent the current from going round.

10. The interrupter for the circuit breaker according to claim 1, wherein the movable contactor is a disc-shaped conductor having a face facing to the fixed contactor, the face comprising:

at least one flat surface for connection with the fixed contactor;

at least one slant surface being slanted in order not to be connected to the fixed contactor so that a separation speed can be improved when separated from the fixed contactor;

a groove being formed at a center portion in order to prevent the arc from being generated at the center portion; and several pairs of linear slits forming a plurality of linear current paths, and being formed in parallel having a predetermined length from the rim, in order to prevent the current from going round.

11. The interrupter for the circuit breaker according to claim 1, further comprising a container for receiving the fixed electrode, the fixed contactor, the movable electrode and the movable contactor in an inner room of a vacuum state.

12. The interrupter for the circuit breaker according to claim 1, further comprising a container for receiving the fixed electrode, the fixed contactor, the movable electrode and the movable contactor in an inner room filled with an insulation gas.

13. An interrupter for a circuit breaker, comprising:

a first conductive rim for providing a conductive path where the current flows;

a wheel-shaped fixed electrode including a plurality of first conductive spokes connected to the first conductive rim in order to provide the conductive path where the current flows, a plurality of horizontal loops of conductive path being formed by the first conductive rim and the first conductive spokes, a plurality of vertical magnetic fields being formed by the plurality of loops of conductive path;

a disc-shaped fixed contactor;

a plurality of first conductive pins for electrically connecting the fixed contactor and the fixed electrode;

a second conductive rim for providing a conductive path where the current flows;

a wheel-shaped movable electrode including a plurality of second conductive spokes connected to the second conductive rim in order to provide the conductive path where the current flows, a plurality of horizontal loops of conductive path being formed by the second conductive rim and the second conductive spokes, a plurality of vertical magnetic fields being formed by the plurality of loops of conductive path;

a plurality of second conductive pins for electrically connecting the movable contactor to the movable electrode; and a reinforcing member arranged between the fixed electrode and the fixed contactor or between the movable electrode and the movable contactor, in order to prevent an impact generated when the fixed contactor and the movable contactor are contacted from being concentrated on the first conductive pins or the second conductive pins.

* * * * *